US006171658B1

(12) United States Patent
Zaretsky et al.

(10) Patent No.: US 6,171,658 B1
(45) Date of Patent: Jan. 9, 2001

(54) COATING METHOD USING ELECTROSTATIC ASSIST

(75) Inventors: Mark C. Zaretsky, Rochester; Steven A. Billow, Pittsford, both of NY (US); Roger A. Whitney, Stanmore (GB)

(73) Assignee: Eastman Kodak Company, Rochester, NY (US)

( * ) Notice: Under 35 U.S.C. 154(b), the term of this patent shall be extended for 0 days.

(21) Appl. No.: 09/408,221

(22) Filed: Sep. 29, 1999

Related U.S. Application Data

(63) Continuation-in-part of application No. 09/020,094, filed on Feb. 6, 1998, now abandoned.

(51) Int. Cl.[7] ..... B05D 1/04; B05D 1/26

(52) U.S. Cl. ..... 427/472; 427/420; 427/532

(58) Field of Search ..... 427/420, 472, 427/532; 118/410, 620, 640

(56) References Cited

U.S. PATENT DOCUMENTS 3,335,026 * 8/1967 De Geest et al. .
3,730,753 * 5/1973 Kerr .
4,835,004 * 5/1989 Kawanishi .
4,837,045 * 6/1989 Nakajima .

FOREIGN PATENT DOCUMENTS

89/05477 * 6/1989 (WO) .

* cited by examiner

*Primary Examiner*—Fred J. Parker
(74) *Attorney, Agent, or Firm*—Mark G. Bocchetti

(57) ABSTRACT

A coating method comprising advancing a web over a coating roller, applying electrostatic charges on the web or coating roller, and coating the web wherein the surface of the web to be coated has a characteristic electrical length of less than 400 $\mu$m.

20 Claims, 3 Drawing Sheets

COATING METHOD USING ELECTROSTATIC ASSIST

CROSS-REFERENCE TO RELATED APPLICATIONS

This is a continuation-in-part of application Ser. No. 09/020,094, filed Feb., 6, 1998 , abandoned entitled COATING METHOD USING ELECTROSTATIC ASSIST, by Mark Zaretsky et al.

FIELD OF THE INVENTION

This invention relates generally to methods for coating liquids onto moving substrates, more particularly to methods for increasing the coating speed and uniformity of mixtures or solutions using electrostatic assistance.

BACKGROUND OF THE INVENTION

This invention relates in general to the art of coating and in particular to an improved method for carrying out a process of coating in which one or more layers of coating composition, preferably a conductive composition, are applied to the surface of a substrate by advancing the substrate through a coating zone in which a flow coating composition is applied thereto, for example, a process of bead coating or a process of curtain coating. More specifically, this invention relates to an improved coating method in the manufacturing of a photographic film, photographic paper, photographic printing layer, a magnetic recording tape, an adhesive tape, pressure-sensitive recording layer, an offset printing plate material or the like.

A method of applying an electrostatic force to assist in a coating method, along with a conventional method of coating a continuously moving web, has been previously disclosed. For example, as disclosed by Hartman in WO 89/05477, ionizers may be used to deposit polar charge on the web prior to the coating application locus to generate an electrostatic field at the coating application locus for a curtain coating method. This electrostatic assist enables the coating method to operate at increased speeds without the defect of air bubbles trapped in the coating layers or between the web and the coated layer. Many prior patents are cited by Hartman discussing the use of polar charge assist in a bead coating method, as well as methods of measuring and controlling the electrostatic field so that a uniform charge of the required magnitude is obtained. These patents do not describe any particular electrical properties of the web that are particularly helpful to the use of electrostatic assist for a coating method.

In another example disclosed by De Geest in U.S. Pat. No. 3,335,026, a potential difference is applied between the coating roller and the coating composition to generate an electrostatic field to attract the coating composition to the web. This patent constrains the resistivity of the web surface to be greater than $10^9$ ohms/square. However, as is shown below in the description of the present invention, it is not the surface resistivity alone, but its combination with the web speed and web capacitance while on the coating roller that determines the effectiveness of the electrostatic assist. Thus, it is possible to use electrostatic assist for web surfaces having a resistivity less than $10^9$ ohms/square. Furthermore, De Geest does not address the issue of designing a support with respect to surface resistivity and web capacitance so as to achieve a specified coating speed using electrostatic assist with minimized coating roller voltage levels. By minimized coating roller voltage levels it is meant that the voltage level is preferably as close as possible to the voltage level required when using an insulating web having a surface resistivity greater than $10^{13}$ ohms/square.

In another example disclosed by Nakajima in U.S. Pat. No. 4,837,045, an electrostatic force on a coating composition is combined with a web having a gelatin-subbing layer containing a surfactant. This electrostatic force allows an increase in speed of coating without increasing the load of drying the coated layers. The gelatin-subbing layer is required to contain a surfactant to achieve the desired electrostatic assist.

In another example disclosed by Kawanishi in U.S. Pat. No. 4,835,004, web temperature control is used to reduce the non-uniformity of and preserve the level of electrical charges deposited on the web by a set of ionizers prior to the coating application locus. This uniform charge is then used to provide an electrostatic assist for the coating method to yield defect-free coatings. This patent places certain requirements on the environment (temperature, relative humidity (RH)) of the web prior to the coating application locus to achieve a uniform charge.

Thus, there is a need for a method for coating emulsions at high speeds without having air bubbles entrained in the coated layer and with no loss in adherence using electrostatic assist regardless of the presence, or absence, of surfactants in a gelatin subbing layer and without placing restrictions on the environment of the web prior to the coating application locus.

SUMMARY OF THE INVENTION

Accordingly, several objects and advantages of the present invention are:

1) to provide a coating method that utilizes an electrostatic force to increase coating speed without modifying the coating composition and without suffering from entrained air bubbles in the coated layers or between the web and the coated layers;
2) to provide a coating method that ensures the existence of an electrostatic force at the coating application locus without the need for surfactant-containing gelatin subbing layers;
3) to provide a methodology for designing a support with respect to surface resistivity and web capacitance so as to achieve a specified coating speed using electrostatic assist with minimized coating roller voltage levels.;
4) to minimize the voltage or charge level required at the coating point for a desired electrostatic force to minimize the possibility of arcing and glow during or after coating and to minimize electrostatic charge remaining on the web after coating.

The above and other objects of the present invention can be achieved through use of a fundamental parameter, the characteristic electrical length, $\lambda$, expressed in micrometers ($\mu$m), determined by the electrical properties of the web and the coating speed of the web. The relationship of $\lambda$ to a voltage applied to the coating roller, as shown in FIGS. 2 and 3, permits for the first time the calculated placement of an intended coating at an optimally robust level of electrostatic assist.

The characteristic electrical length is defined as the reciprocal of the product of the web surface resistance (ohms/square), web capacitance while on the coating roller ($F/m^2$)—defined as the ratio of the web permittivity (F/m) divided by the web thickness (m), and the web speed (m/s). A characteristic electrical length less than 400 $\mu$m, and preferably less than 100 $\mu$m, is desirable. When meeting this criterion, the web surface voltage in the vicinity of the coating point (within 100 $\mu$m) remains at a level sufficient to apply a significant electrostatic force on the coating composition. This criterion is independent of whether the electrostatic force is applied via polar charge deposited on the web or a potential difference applied between the coating roller and the coating composition or a combination of these two methods.

The failure mode of entrained air in the coating is encountered at some point as coating speed is increased. This failure mode can be suppressed until higher speeds by the application of an electrostatic force between the fluid and web. Achieving this force requires an electrostatic charge or electrostatic voltage source as well as some constraints on the electromechanical properties of the web, both bulk and surface-to-be-coated. The present invention properly provides these constraints, ensuring the full effectiveness of the electrostatic charge or voltage. Coatings made in accordance with the invention are not dependent upon the use of any particular surfactant in the gelatin layer on the surface of a web to be coated, nor are they dependent upon control of the environment (RH, temperature) the web encounters prior to the coating process.

BRIEF DESCRIPTION OF THE DRAWINGS

The foregoing and other objectives, features, and advantages of the invention, as well as presently preferred embodiments thereof, will become more apparent from a reading of the following description in connection with the accompanying drawings in which.

DETAILED DESCRIPTION OF THE INVENTION

Figure 1:
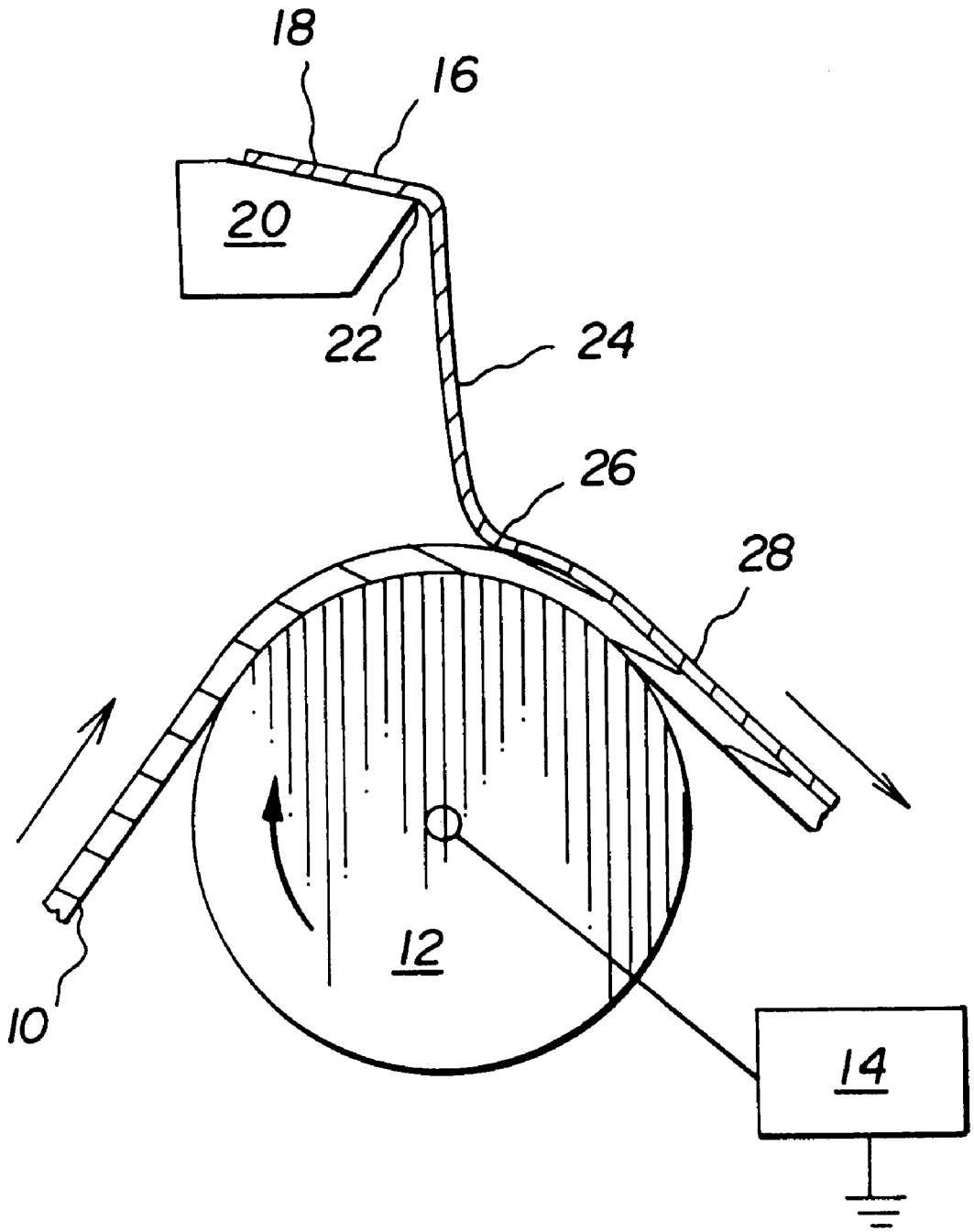
FIG. 1 is a schematic vertical cross-sectional view of an apparatus for coating in accordance with a method of the invention.

As shown in FIG. 1, a web 10 is conveyed around a coating roller 12. Coating roller 12 is electrically isolated and connected to a high voltage power supply 14. A coating fluid 16 flows over an inclined surface 18 of a coating die 20 and falls freely in a thin film over the edge 22 of the die, forming a curtain 24. Curtain 24 falls by gravity and impinges on the continuously moving web 10 at coating application point 26 resulting in a continuous coating 28.

Web 10 may be a plastic film, a plain paper, a plastic-coated paper, synthetic paper, glass, cloth, ceramic or any other dielectric material capable of maintaining an electrostatic potential difference between opposite surfaces thereof. The plastic film may be composed of, for example, a polyolefin such as polyethylene and polypropylene; a vinyl polymer such as polyvinyl acetate, polyvinyl chloride and polystyrene; a polyamide such as 6,6-nylon and 6-nylon; a polyester such as polyethylene terephthalate and polyethylene-2,6-naphthalate, polycarbonate; a cellulose acetate such as cellulose triacetate and cellulose diacetate; a cellulose nitrate; or the like. The plastic used for a plastic-coated paper may be an alpha-olefin, as exemplified by polyethylene and polypropylene, but is not confined thereto. The web 10 may have one or several layers previously coated on top of the base support.

To improve adhesion of the coating composition to the surface of web 10 the surface to be coated may have undergone an electrical discharge treatment and may have a subbing layer on top of the base web material described above. The discharge treatment may be a corona discharge treatment or a glow discharge treatment or an atmospheric glow discharge treatment. The subbing layer may contain gelatin or other polymeric binders as well as a surfactant, surfactants being typically added to aid in the coating of the subbing composition during the base manufacturing process.

The composition of the coating liquid may be varied according to the use thereof. For example, the liquid may be used to form a photosensitive emulsion layer, undercoating layer, protective layer, backing layer, antistatic or antihalation layer, or the like of a photographic photosensitive material, an ink- absorbing layer in the case of inkjet receiver media, a magnetic layer, undercoating layer, lubricant layer, protective layer, backing layer or the like of a magnetic recording medium, an adhesive layer, a coloring layer, an anti-rusting layer or the like. The coating composition can contain a water-soluble binder or an organic solvent-soluble binder.

Various types of surfactants in the coating composition can be used to modify the surface tension and coatability of the coating composition in accordance with this invention. Useful surfactants include saponin; non-ionic surfactants such as polyalkylene oxides, e.g., polyethylene oxides, and the water-soluble adducts of glycidol and alkyl phenol; anionic surfactants such as alkyaryl polyether sulfates and sulfonates; and amphoteric surfactants such as arylalkyl taurines, N-alkyl and N-acyl beta-amino propionates; alkyl ammonium sulfonic acid betaines, etc.

The coating method may be a slide coating method, a roller bead coating method, a spray coating method, an extrusive coating method, a curtain coating method, or the like.

Given that the coating die is at ground potential and the coating composition is conductive enough to be considered at ground potential also, the voltage distribution on the surface of a web to be coated ($V_S$), while on a coating roller raised to a high voltage, and prior to the coating point, is determined by the applied coating roller voltage ($V_R$) in the following manner:

$$V_S = V_R(1 - e^{x/\lambda}) \qquad \text{Equation 1}$$

where x is the distance, in meters, from the coating point ($x<0$ $\mu$m before the coating point) and $\mu$ is the characteristic electrical length. This model incorporates several simplifying assumptions: 1) there are no electrostatic charges internal to the web, only on the upper or lower surfaces, 2) charges on the upper and lower web surface can be taken into account by the addition of a voltage term ($V_{web}$) on the right-hand side of the above equation, where $V_R$ would be replaced by $V_R+V_{web}$, and 3) the capacitive coupling of the web-to-ground via the coating composition as the web approaches the coating application locus is neglected.

The critical parameter $\lambda$ is determined by the following formula $$\lambda = [\rho_S C U]^{-1} \qquad \text{Equation 2}$$

where $\rho_S$ is the web surface resistance on the side to be coated (ohms/square), C is the web capacitance per unit area while on the coating roller (F/m$^2$), and U is the web speed (m/s).

Figure 2:
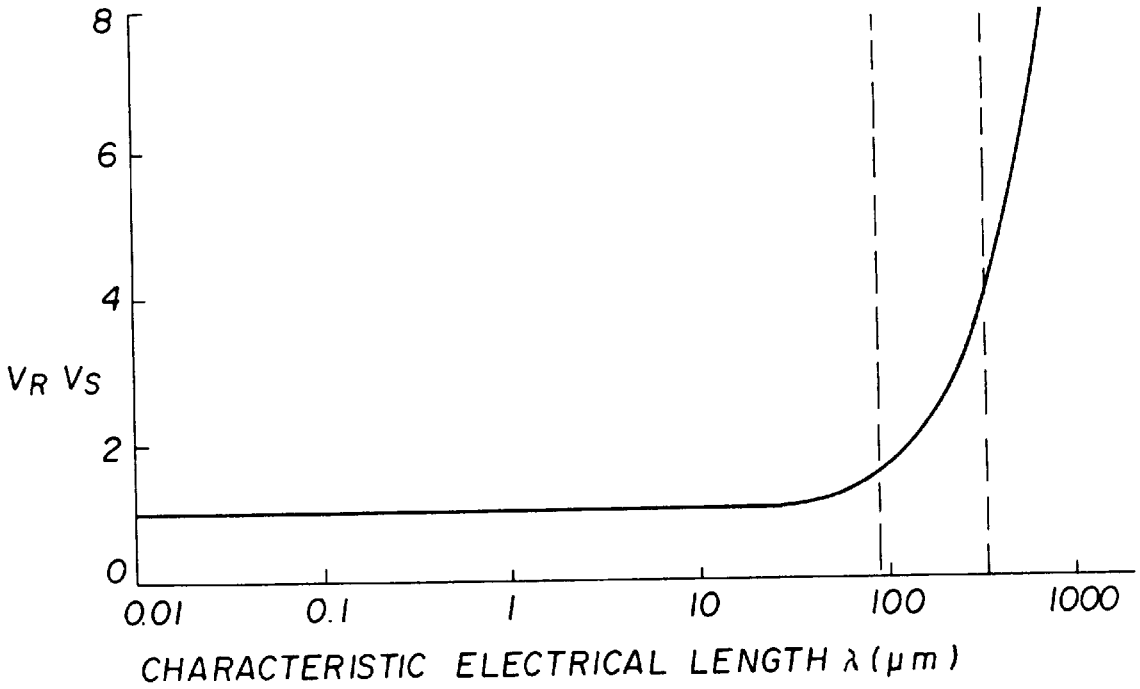
FIG. 2 is a graph showing the dependence of the ratio of the voltage applied to the coating roller ($V_R$) to the voltage on the web surface ($V_S$) as a function of the characteristic electrical length ($\lambda$) of the web surface to be coated.

The voltage ratio $$\frac{V_R}{V_S}$$

is greatly impacted by λ, as shown in FIG. 2. The plot shows the ratio of the voltage applied to the coating roller ($V_R$) to the voltage at the web surface ($V_S$) as a function of characteristic electrical length λ of the web surface to be coated, evaluated at a location 50 μm upstream from the coating point (x=−50 μm). For short characteristic electrical lengths, small λ, such as those given by insulating webs, $V_S$ equals $V_R$ . The full effect of the coating roller voltage $V_R$ , as controlled by high voltage power supply 14, is seen at the web surface and the maximum electrostatic force is exerted upon the coating liquid. For longer lengths, larger λ, the roller voltage $V_R$ must be increased in order to maintain the same web surface voltage $V_S$ and hence, the same electrostatic force upon the coating liquid. Therefore, a web surface having a longer characteristic electrical length λ requires a higher coating roller voltage $V_R$ as compared to a web surface having a shorter characteristic electrical length λ to obtain the same electrostatic force upon the coating liquid.

For a voltage ratio of 2.54 or less the characteristic electrical length must be less than 100 μm. As the characteristic electrical length increases due, for example, to a lower web surface resistivity for a fixed web capacitance/area and web speed, the voltage ratio increases. For a voltage ratio of 8.5 or less, this length must be less than 400 μm. Therefore, to compensate for longer lengths λ, as for webs having a higher surface conductivity, higher voltages must be used to achieve the same electrostatic force. This is undesirable as higher voltages may be more difficult to achieve or may result in arcing or unacceptable glow at the coating roller or higher web charges remaining after coating. Using equation 2 the characteristic electrical length is 93 μm.

EXAMPLE 1

A set of webs was made having different values of surface resistivity on the surface to be coated. The range of surface resistivity values was estimated using equation 2 and given a web capacitance/area while on the coating roller of 28 pF/cm$^2$ ($3.2\epsilon_0$/100 μm), a web speed range of roughly 2.5 to 10 m/s, and a range of characteristic electrical lengths from 0.04 μm to 1400 μm based upon FIG. 2. This range of surface resistivity was determined to be from $10^9$ to $10^{13}$ ohms/square. Surface resistivity was controlled via a tin oxide/gelatin layer on the web, which was a 100 μm thick polyester support. For the tin oxide/gel ratio used, this layer is relatively insensitive to ambient RH, providing a constant surface resistivity as the web approached the coating point. Tin oxide/gel subbing layers were coated both with and without incorporation of the surfactant saponin. These subbing layers were subsequently coated upon with an 11.8% aqueous mixture of gelatin at a flow rate per unit width of 4 cm$^2$/s. The curtain coating method was used with a curtain height of approximately 10 inches and application angle at the coating roller of +15 degrees. The coating roller voltage required to eliminate air entrainment for a given speed was measured as a function of web surface resistivity. The desired web surface voltage $V_S$ was taken to be roughly constant with distance upstream of the coating point (x) and equal to the coating roller voltage $V_R$, obtained when coating a relatively insulative web having a characteristic electrical length of less than 5 μm, for a given combination of speed and surfactant level.

Figure 3:
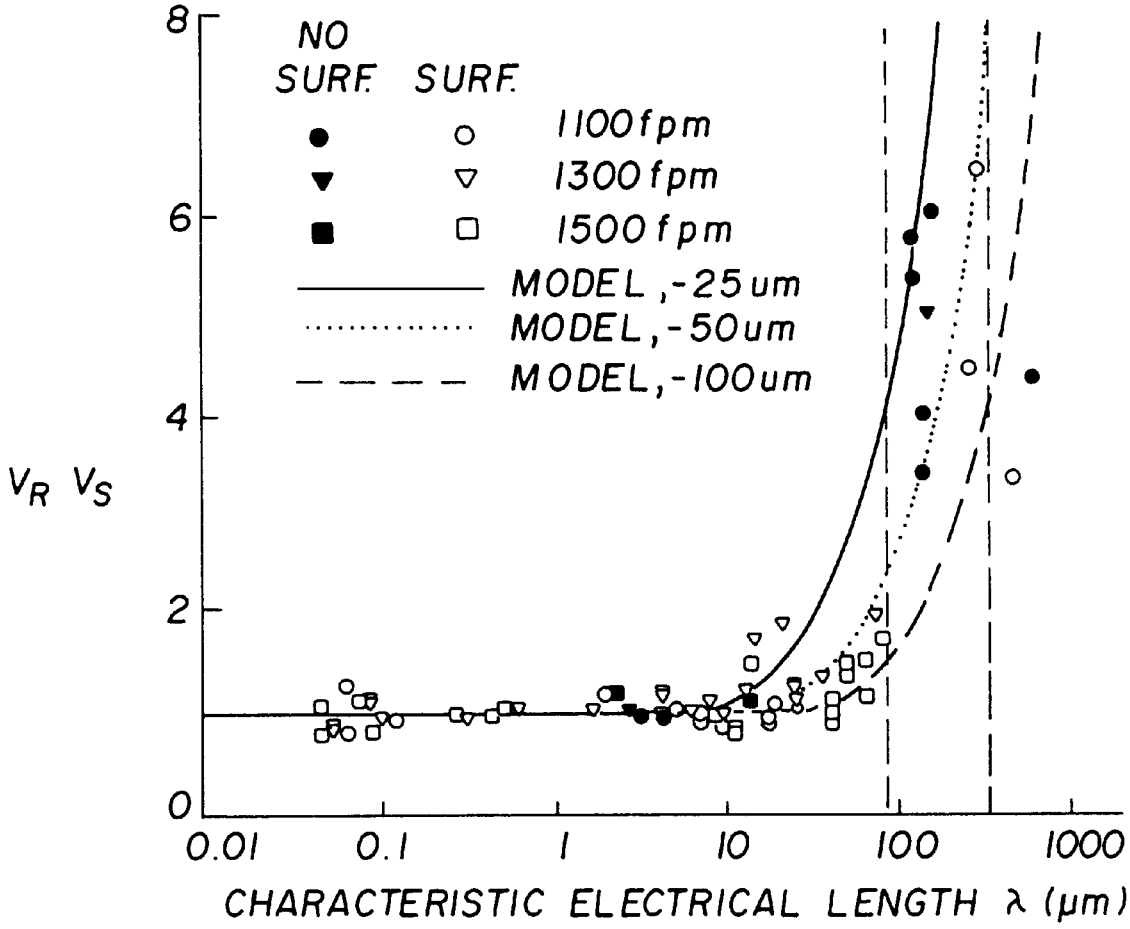
FIG. 3 is a graph showing data from various coatings with and without surfactant superimposed on characteristic curves like that shown in FIG. 2 for three different distances upstream of the coating locus.

FIG. 3 presents the results obtained with these supports having different characteristic electrical lengths, for three different coating speeds, 5.5, 6.5 and 7.5 m/s. ( approximately 1100, 1300, and 1500 Rpm ) Results are shown for supports having a wide range of surface resistance (characteristic electrical length). Also plotted in FIG. 3 are the predicted voltage ratio of $$\frac{V_R}{V_S}$$

as a function of λ for three different distances x upstream of the coating point, −25, −50 and −100 μm, using equation 1 provided above. The voltage ratio required to maintain a given maximum coating speed before air entrainment increases with characteristic electrical length (decreasing surface resistivity). This relationship follows the dependence shown in FIG. 2. Also, this relationship is independent of the presence of surfactant (hollow symbols), or lack thereof (filled symbols), in the subbing layer. Uniform coatings without air entrainment were achieved at λ<400 μm and more robustly at λ<100 μm at coating roller voltages low enough to minimize arcing and glow during or after coating and to minimize formation of electrostatic charge remaining on the back side of the web after coating.

EXAMPLE 2

For an existing product it is desirable to replace an existing 100 μm thick polyester web support with a new support. The existing product is successfully curtain-coated at 7.5 m/s with the benefit of electrostatic assist, using a coating roller voltage of 800V. Given a web capacitance/area of 28 pF/cm$^2$ ($3.2\epsilon_0$/100 μm), while on the coating roller, and a surface resistivity of $10^{13}$ ohms/square, the characteristic electrical length for this application is 0.05 μm using equation 2 provided above. Therefore, using equation 1 the web surface voltage at the coating point equals the coating roller voltage at upstream distances close to the coating application point (within 50 μm to 100 μm).

The new support differs from the existing one only in the fact that the surface to be coated has a different subbing layer, having a lower resistivity of $10^{9.82}$ ohms/square. It is desirable to maintain the 7.5 m/s coating process speed with the same coating hardware setup and electrostatic assist. However, due to the decrease in surface resistivity, the characteristic electrical length has now increased to 71 μm using equation 2. Using FIG. 2 or equation 1 with x=−50 μm, $$\frac{V_R}{V_S} \approx 2$$

which implies that the coating roller voltage will have to be roughly doubled to 1600V in order to achieve the same web surface voltage, and electrostatic assist force on the coating liquid.

EXAMPLE 3

For an existing product it is desirable to replace an existing 100 μm thick polyester web support with a new support. The existing product is successfully curtain-coated at 7.5 m/s with the benefit of electrostatic assist, using a coating roller voltage of 500V. Given a web capacitance/area of 28 pF/cm$^2$ ($3.2\epsilon_0$/100 μm), while on the coating roller, and a surface resistivity of $10^{13}$ ohms/square, the characteristic electrical length for this application is 0.05 μm using equation 2 provided above. Therefore, using equation 1 the web surface voltage at the coating point equals the coating roller voltage at upstream distances close to the coating application point (within 50 $\mu$m to 100 $\mu$m).

The new support differs from the existing one only in the fact that the surface to be coated has a different subbing layer. The surface resistivity of this subbing layer is known to vary with the level of a constituent, tin-oxide, added to the subbing layer. It is also known that for coating roller voltages beyond 1500V, the coating machine used to make this product experiences arcing from the coating roller to surrounding equipment. Therefore, it is desirable to design the subbing layer such that voltages <1500V are capable of producing uniform coatings at 7.5 m/s with the same coating hardware setup. Therefore, $$\frac{V_R}{V_S} \leq \frac{1500\text{V}}{500\text{V}}$$

3.0. From FIG. 2 or using equation 1 with x=−50 $\mu$m, this implies the characteristic electrical length must be less than or equal to 124 $\mu$m. From Equation 2 it can be found that the surface resistivity must be greater than $10^{9.58}$ ohms/square if the product is to be coated at 7.5 m/s. Knowledge of the surface resistivity of the subbing layer as a function of tin-oxide concentration allows the designer to determine allowable ranges of tin-oxide concentration that will permit the coating process to successfully operate at coating roller voltages less than or equal to 1500 V.

Determination and control of the characteristic electrical length of the surface of a web to be coated is extremely helpful in setting the levels of electrostatic assist for a desired coating speed. This length can be independent of the presence of surfactants in a subbing layer as well as independent of the web temperature prior to coating. The benefits of minimizing the characteristic electrical length lie in the concomitant minimization of the voltage needed to provide the assist, resulting in reduced opportunities for arcing and glow at or near the coating point and little or no electrostatic charge remaining on the web after coating.

The above results and corresponding dependence upon surface resistivity are also true for variations in web speed or web capacitance due to their effect upon the characteristic electrical length.

The above results are not limited to coating method, being equally applicable to methods other than curtain coating, such as bead or extrusion coating. In addition, the electrostatic force may be derived from charge deposited on the web prior to the coating point, in conjunction with or instead of an electrified coating roller.

From the foregoing description, it will be apparent that there has been provided an improved method for coating a liquid to a web to form a uniform coated layer, wherein a novel calculable coating parameter, the characteristic electrical length, may be predetermined to provide an intended coating with an optimally robust level of electrostatic assist. Variations and modifications of the herein described coating method within the scope of the invention will undoubtedly suggest themselves to those skilled in this art. Accordingly, the foregoing description should be taken as illustrative and not in a limiting sense.

What is claimed is:

1. A method for coating a liquid composition to a web substrate at a coating application point while moving in contact with and around a coating roller to form a coating on a surface of the web substrate, comprising the steps of:

a) setting a characteristic electrical length ($\lambda$) to be less than about 400 $\mu$m by varying one or more of the parameters of the surface resistance ($\rho_S$) on the surface of the web substrate to be coated, the web capacitance per unit area (C) of the web substrate in contact with the coating roller, and the coating speed (U) for said web substrate wherein $\lambda$ is determined by the equation $\lambda=(\rho_S CU)^{-1}$;

b) controlling the voltage on the surface of the web ($V_S$) by controlling the voltage applied to the coating roller ($V_R$) using the equation $V_S=V_R(1-e^{x/\lambda})$ wherein e is a constant and x is a distance before the coating application point on the web substrate and is in the range of from about 50 $\mu$m to about 100 $\mu$m; and c) delivering said liquid composition from a coating die to said web substrate at said coating application point traveling at said speed U to form a coated web substrate.

2. A method in accordance with claim 1 wherein $\lambda$ is less than 100 $\mu$m.

3. A method in accordance with claim 1 wherein $$\frac{V_R}{V_S}$$

is less than 2 for $-100\ \mu\text{m} \leqq x \leqq 0\ \mu\text{m}$.

4. A method in accordance with claim 1 wherein electrostatic charges are placed on the surface of said web substrate prior to said applying step to provide an electrostatic force.

5. A method in accordance with claim 1 wherein electrostatic charges are placed on the coating roller prior to and during said applying step to provide an electrostatic force.

6. A method in accordance with claim 1 wherein a voltage differential is established between a coating roller and said liquid composition during said applying step to provide an electrostatic force.

7. A method in accordance with claim 1 wherein said delivered liquid composition is a photosensitive material.

8. A method in accordance with claim 1 wherein said web substrate is selected from the group consisting of polyester film, cellulose acetate film, and plastic-coated paper.

9. A method in accordance with claim 1 comprising the additional step of coating said web substrate with a gelatin subbing layer prior to said applying step.

10. A method in accordance with claim 9 wherein said gelatin subbing layer includes a surfactant.

11. A method for coating a liquid composition to a web substrate at a coating application point while moving in contact with and around a coating roller to form a coating on a surface of the web substrate, comprising the steps of:

a) setting a characteristic electrical length ($\lambda$) to be less than about 400 $\mu$m by varying one or more of the parameters of the surface resistance ($\rho_S$) on the surface of the web substrate to be coated, the web capacitance per unit area (C) of the web substrate in contact with the coating roller, and the coating speed (U) for said web substrate wherein $\lambda$ is determined by the equation $\lambda=(\rho_S CU)^{-1}$;

b) controlling the voltage on the surface of the web ($V_S$) by controlling both the voltage applied to the coating roller ($V_R$) and the charge applied to the web surface prior to the coating point ($V_{web}$) using the equation $V_S=(V_R+V\text{web})(1-e^{x/\lambda})$ wherein e is a constant and x is a distance before the coating application point on the web substrate and is in the range of from about 50 $\mu$m to about 100 $\mu$m; and c) delivering said liquid composition to said web substrate at said coating application point traveling at said speed U to form a coated web substrate.

12. A method in accordance with claim 11 wherein $\lambda$ is less than 100 $\mu$m.

13. A method in accordance with claim 11 wherein $$\frac{V_R}{V_S}$$

is less than 2 for $-100\ \mu m \leqq x \leqq 0\ \mu m$.

14. A method in accordance with claim 11 wherein electrostatic charges are placed on the surface of said web substrate prior to said applying step to provide an electrostatic force.

15. A method in accordance with claim 11 wherein electrostatic charges are placed on the coating roller prior to and during said applying step to provide an electrostatic force.

16. A method in accordance with claim 11 wherein a voltage differential is established between a coating roller and said liquid composition during said applying step to provide an electrostatic force.

17. A method in accordance with claim 11 wherein said delivered liquid composition is a photosensitive material.

18. A method in accordance with claim 11 wherein said web substrate is selected from the group consisting of polyester film, cellulose acetate film, and plastic-coated paper.

19. A method in accordance with claim 11 comprising the additional step of coating said web substrate with a gelatin subbing layer prior to said applying step.

20. A method in accordance with claim 19 wherein said gelatin subbing layer includes a surfactant.

* * * * *